United States Patent [19]

Linehan

[11] 4,164,378

[45] Aug. 14, 1979

[54] ROPE FITTING

[75] Inventor: Joseph J. Linehan, Arlington, Mass.

[73] Assignee: Samson Ocean Systems, Inc., Boston, Mass.

[21] Appl. No.: 920,774

[22] Filed: Jun. 30, 1978

Related U.S. Application Data

[63] Continuation-in-part of Ser. No. 830,325, Sep. 2, 1977, abandoned.

[51] Int. Cl.[2] ..... F16G 11/00

[52] U.S. Cl. ..... 403/210; 114/230; 114/293; 403/267; 403/268; 403/161

[58] Field of Search ..... 403/210, 206, 267, 268, 403/266, 265, 291, 157, 158, 161, 162; 9/8 P; 254/192, 197; 114/230, 293

[56] References Cited

U.S. PATENT DOCUMENTS

| | | | |
|---|---|---|---|
| 3,133,521 | 5/1964 | Cappel | 114/230 |
| 3,328,229 | 6/1967 | Windecker | 403/267 X |
| 3,426,613 | 2/1969 | Conrad | 403/267 X |
| 3,702,709 | 11/1972 | Shaffer | 403/210 X |

FOREIGN PATENT DOCUMENTS

| | | | |
|---|---|---|---|
| 1160841 | 3/1958 | France | 403/265 |

*Primary Examiner*—Wayne L. Shedd
*Attorney, Agent, or Firm*—W. R. Hulbert

[57] ABSTRACT

A rope fitting is provided for heavy ropes usable for securing large ships to single point mooring buoys and the like as a substitute for conventional thimbles. The crown of an eye formed in the rope is fitted with a sheave and both are encapsulated in a suitable material such as urethane plastic thereby forming a plug which can be inserted in a shroud attachable by a cylindrical bore to a shackle by a shackle bolt. The sheave distributes the load to the rope eye. The unit is much lighter in weight than conventional gear, reducing shipping costs and is capable of being fitted to hardware in the field without trained personnel or special equipment. More than one rope can be so connected to a single multi-shroud unit.

9 Claims, 5 Drawing Figures

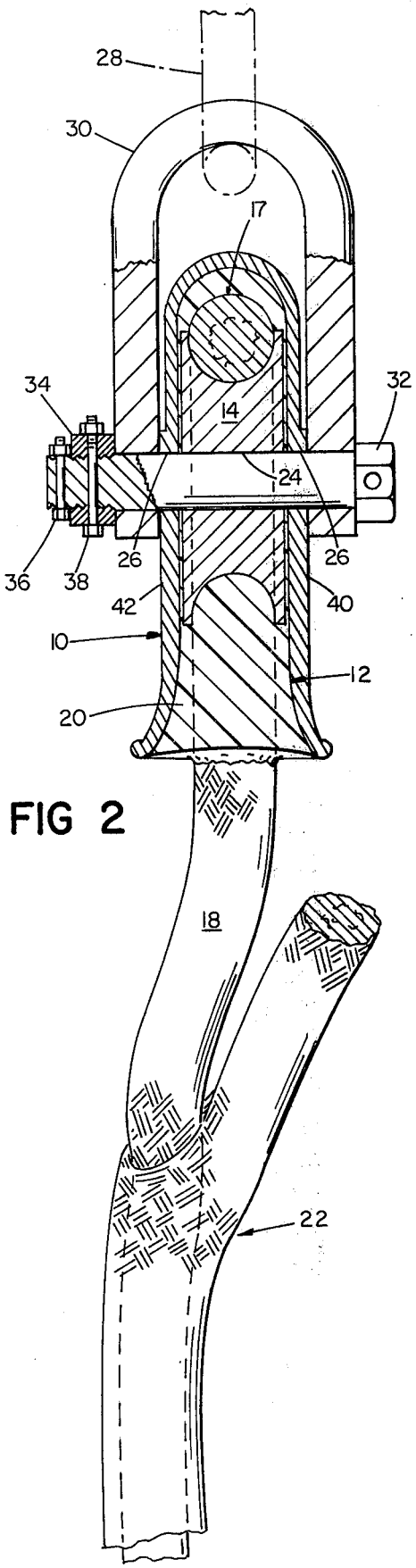
FIG 2
FIG 1
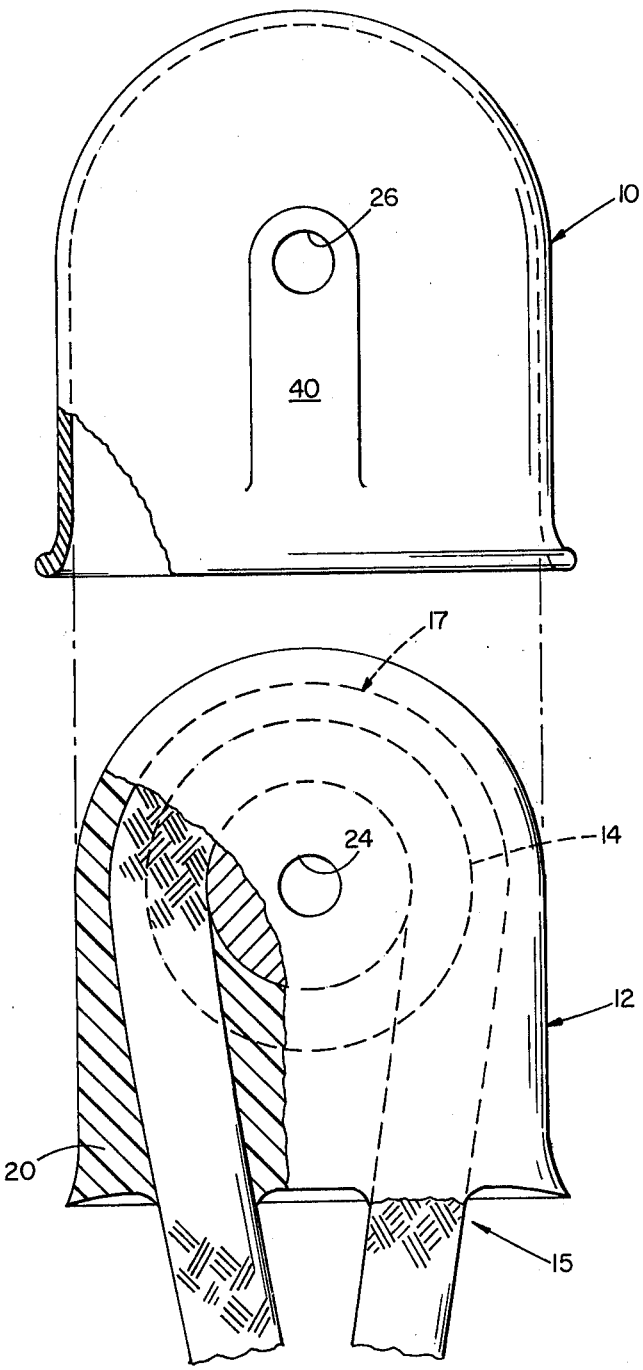

ROPE FITTING

CROSS REFERENCE

This is a continuation-in-part of application Ser. No. 830,325 filed Sept. 2, 1977, now abandoned.

BACKGROUND OF THE INVENTION

The invention relates to fittings for connecting heavy mooring ropes to buoys or ships, particularly fittings large enough to accept the large diameter ropes used to secure tankers and other large ships to single point mooring buoys.

Mooring of ships, especially enormous ships such as super-tankers, by means of synthetic ropes and associated hardware presents problems which are a whole order of magnitude different from those encountered in the conventional prior practice. The ropes used may be from 2" (48 mm) to 10" (240 mm) in diameter and the hardware (usually of expensive material such as stainless steel) instead of weighing a few pounds may be of the order of thousands of pounds and correspondingly vastly more costly. Since the massive and expensive hardware, shackles, swivels, thimbles, etc., in normal use have a longer useful life than the ropes it is desirable to re-use rather than to discard them when the rope becomes unsafe through wear and this poses the problem of attaching fresh rope to hardware, possibly at some remote port in the world, without the availability of expert assistance and equipment. Ropes of the diameters in question are not readily eye-spliced and the eyes fitted properly to conventional thimbles without trained personnel and special equipment.

It has been proposed to encapsulate in suitable plastic at the factory the eye of an eye-spliced rope together with a thimble in which it has been inserted so that the thimble not only supports the inner surface of the eye but provides surrounding metal to protect the outer surface of the rope against damage or abrasion. The result is a factory-prepared and shipped rope or hawser with a very heavy and expensive thimble at each end, the thimble and the eye portion of rope therein being together encapsulated in plastic to form a long-wearing, but heavy, fitting for connection by a shackle to other hardware. When the rope becomes too worn for use the heavy stainless steel plastic encapsulated eye containing thimble can be cut off and shipped back to the cordage manufacturer for cleaning out (a difficult task) for ultimate re-use on the end of a fresh rope. This burdensome procedure can be economically justified only because of the value of the thus reclaimed hardware.

Furthermore, the conventional thimble shape provides only a very sloppy joint between shackle bolt and thimble surface and the bolt will undergo rapid wear by rubbing on this surface in cases where a vessel, moored with a rope equipped with such a thimble, is subjected to enormously large forces from wind, wave, and current.

SUMMARY OF THE INVENTION

The invention features a fitting in a rope providing for connection of the rope by means of a shackle to marine gear, comprising a recurving portion of rope with a crown, a load-distributing structure positioned within the recurving portion, and a mass of tough, wear-resistant plastic material encapsulating the rope crown and the load-distributing structure to form an integral non-adhering plug of predetermined shape for insertion into mating relation with a protective shroud, permitting easy removal therefrom for replacement purposes. The distributing structure has an aperture therethrough passing within the recurving portion of rope perpendicular to the plane thereof for insertion of a shackle bolt and provides a bearing surface for a shackle bolt and distributes a force applied by a shackle bolt to the crown of the recurving portion of rope.

Preferred embodiments of the invention further feature wear-resistant material of a castable urethane rubber with ether type linkages and having a shore hardness in a range between 70A and 50D; a cylindrical aperture sized to provide a close fit with the bolt of the shackle with which said fitting is to be used, confining wear due to relative motion between said plug and a shackle to the cylindrical inner bearing surface of the aperture and the closely fitting outer surface of the shackle bolt; and a sheave used in the load-distributing structure.

Another aspect of the invention features a device for receiving, holding and protecting a rope fitting which comprises a recurving portion with a crown formed in the rope, a load distributing body positioned within the recurving portion and a mass of tough wear-resistant material encapsulating the recurving portion of the rope and the load distributing body to form a plug of predetermined dimensions and configuration with generally flat, opposite sides parallel to the plane of said recurving portion, the plug having an aperture therethrough passing within the receiving portion and the load distributing body, the device comprising a pair of spaced generally parallel metal walls whose facing surfaces are smooth, spaced from each other the smallest dimension of said plug and adapted to engage and support the flat latter when inserted therebetween. The walls being provided with opposed openings located in alignment with the plug aperture when the latter is in its inserted position so that a shackle bolt will pass through the aligned openings to retain the plug in position, and the edges of the walls being faired to provide non-chafing bearing surfaces for the adjacent rope portions.

A further aspect of the invention features a combination of a fitting and a mating shroud as described above.

Another aspect of the invention features a multi-shroud unit adapted to receive a plurality of fittings thereby replacing a corresponding number of individual shrouds to mate with such fittings.

Other features, advantages and objects of the invention will become apparent from the following detailed description of preferred embodiments thereof and of a preferred method of making the same taken in conjunction with the accompanying drawings in which:

FIG. 1 is a disassembled elevation, partially in cross-section, of the encapsulated eye portion and one form of bell envelope (mating shroud) of the novel rope termination;

FIG. 2 is a cross-sectional end view of the embodiment in assembled condition, a portion of the rope eye being broken away;

DESCRIPTION OF FIRST PREFERRED EMBODIMENT

Figure 3:
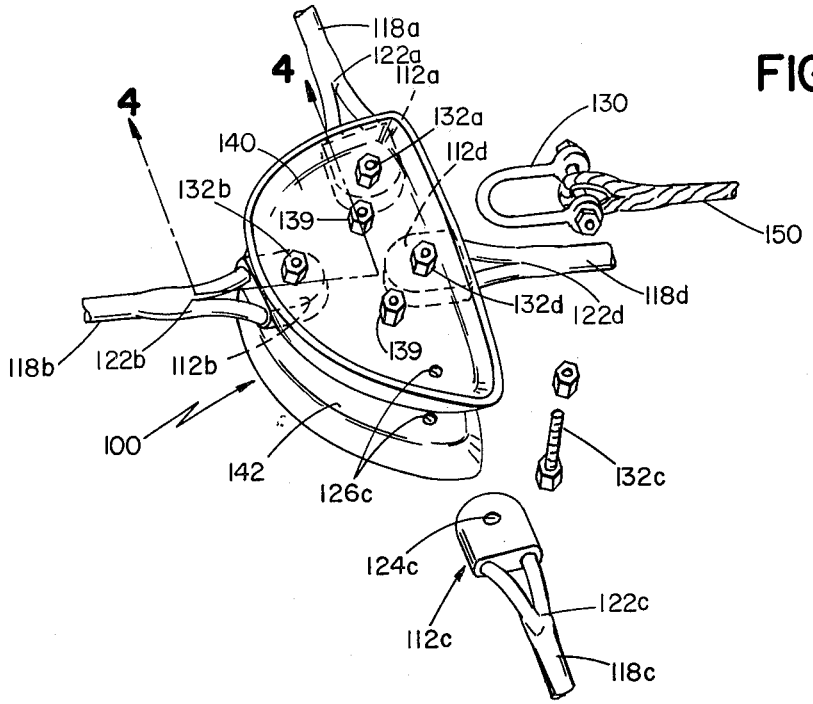
FIG. 3 is an isometric view on a reduced scale of a modified multi-shroud unit capable of accepting a corresponding number of encapsulated rope eye portions.

Turning now to FIG. 1, illustrating one preferred embodiment of the inventions, there is shown bell-shaped protective shroud 10, into which molded plug 12 is inserted. The plug comprises a load-distributing structure 14, which may advantageously be a sheave as shown, to distribute the load from shackle bolt 32 to crown 17 of recurving portion 15 of rope 18. Crown portion 17 together with sheave 14 is encapsulated in plastic 20, molded in the shape of the interior of shroud 10. The recurving portion of rope 15 is produced by eye splice 22 in a known manner. Center hole 24 in the sheave extends through molded plug 12, and when plug 12 is assembled into shroud 10 is aligned with holes 26 therein.

As shown in FIG. 2, the shroud and plug inserted therein are fastened to fairlead chain 28 by conventional shackle 30. Shackle bolt 32 passes through the shackle and with a close fit through holes 24 and 26 in the plug and shroud, and is secured by nut 34. Smaller bolts 36 and 38 serve to lock nut 34 in place. Bearing surfaces 40 and 42 on each side of the exterior of the bell bear against interior surfaces of the shackle.

The rope 18 is natural or synthetic fiber or steel. The eye splice 22 is made in the conventional manner.

The presently preferred plastic is urethane having ether type linkages and a shore hardness in the range 70A to 50D. This plastic is castable with room temperature cure and is non-adhering to the metallic shroud.

This material cures into a hard, wear-resistant and strong body, firmly embedded with the components to form an integral plug which does not adhere to shroud 10 and may be easily inserted or removed therefrom.

PREFERRED METHOD OF MANUFACTURE OF FIRST EMBODIMENT

In order to manufacture this embodiment of the rope fitting of the invention a mold can be provided having the same internal size and shape as the bell-shaped shroud 10 with which the product is to be used. Indeed, it has been found that a shroud itself may be used as a mold. The sheave 14 is fitted into the crown portion 17 in the eye of the rope 18 and together inserted into the shroud 10. Plastic is then introduced into the shroud 10, which is held upright rather than in the position shown in FIG. 1. The plastic sets, embedding the components therein, to form a plug which may then, if desired, be withdrawn from the bell. Alternatively, the bell may then be locked in place by means of a bolt (not shown) or with a shackle 30 for shipment to a customer, depending on whether the customer wishes rope alone or a bell shroud and/or shackle in addition.

OPERATION—FIRST EMBODIMENT

Depending on whether the customer is purchasing a rope system as original equipment or a replacement rope for use in an already acquired system, a rope provided with the fitting of the invention is furnished with or without the bell-shaped shroud 10 and/or the matching shackle 30. As original equipment a rope plus hardware can be utilized to establish a single point mooring for a ship or to secure a ship, such as a tanker, to an offshore oil terminal, or the like. Since the plug 12 comprising the encapsulated rope crown 17 and sheave or other load-distributing structure 14 is relatively light in weight, as compared with the associated hardware, it is much easier to handle than ropes provided with conventional thimbles, which, in the sizes here involved, are very heavy indeed. No special technology or expertise is required to install the plug in existing bell shrouds in the field. Shipping costs are reduced because replacement ropes need not be provided with heavy hardware except in cases where the shackles and/or bell shrouds are too worn, which occurs much less frequently than with the ropes themselves. Additionally, the close fitting between the shackle bolt and the bearing surfaces of the plug reduce wear as compared to conventional designs.

DESCRIPTION OF SECOND PREFERRED EMBODIMENT

In a second embodiment of the invention, an arrangement is provided for further weight saving where several ropes are to be connected to a single point in a mooring system.

In place of the individual bell envelope shroud 10 for each rope termination, I provide an anchoring unit having as many plug receiving and supporting locations as desired, each location having opposing smooth surfaces for engaging and supporting faces of the encapsulated rope eye and being provided with aligned openings to receive a shackle bolt.

Figure 4:
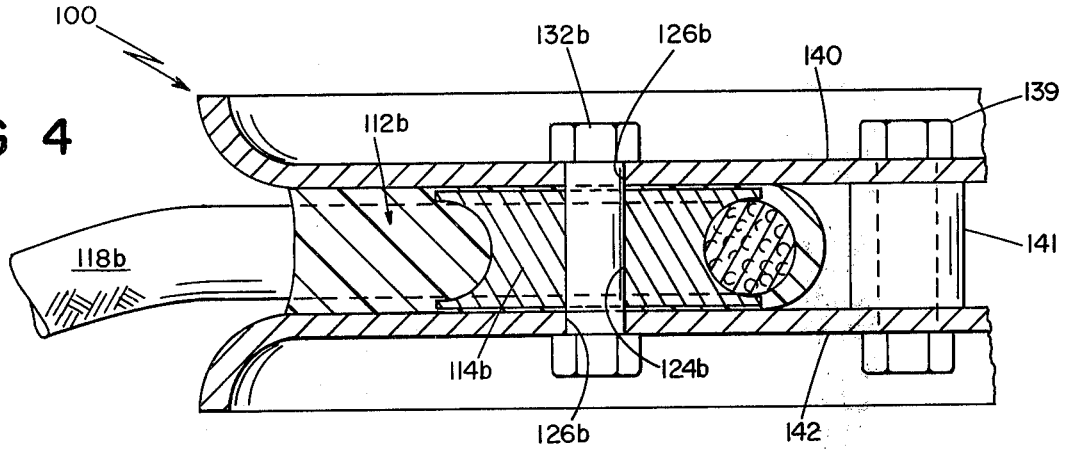
FIG. 4 is a horizontal sectional view on a larger scale taken on line 4—4 of FIG. 3.

Referring to FIGS. 3 and 4, the anchoring unit, which for convenience may be termed a "multi-shroud" unit, comprises upper plate 140 and lower plate 142 held together by bolts 139 which are provided with spacers 141. The edges of the two plates are oppositely faired to provide non-chafing surfaces for the ropes fastened to the unit. As shown in FIG. 3, the unit 100 is provided with connections for four lines, ropes or cables 118$^a$, 118$^b$ and so on, by means of holes 126$^a$, 126$^b$, and so on, and mating shackle bolts 132$^a$, 132$^b$ and so on, which, when installed, serve further to reinforce the unit. At the locations surrounding the openings 126$^a$, 126$^b$, etc., the opposed surfaces of the two plates engage, support and enshroud the opposite faces of plugs 112$^a$, 112$^b$, 112$^c$ or 112$^d$, each comprising the encapsulated crown of an eye splice 122$^a$, 122$^b$ and so on, in rope 118$^a$, 118$^b$ and so on. In this instance, the plug is molded to provide parallel lateral external surfaces which exactly fit between the plates 140, 142. Any of the locations may, optionally, be used to anchor conventional cables or hardware, such as the eye of steel cable 150 or shackle 130 attached to the cable, as shown, rather than an encapsulated plug of the invention.

Figure 5:
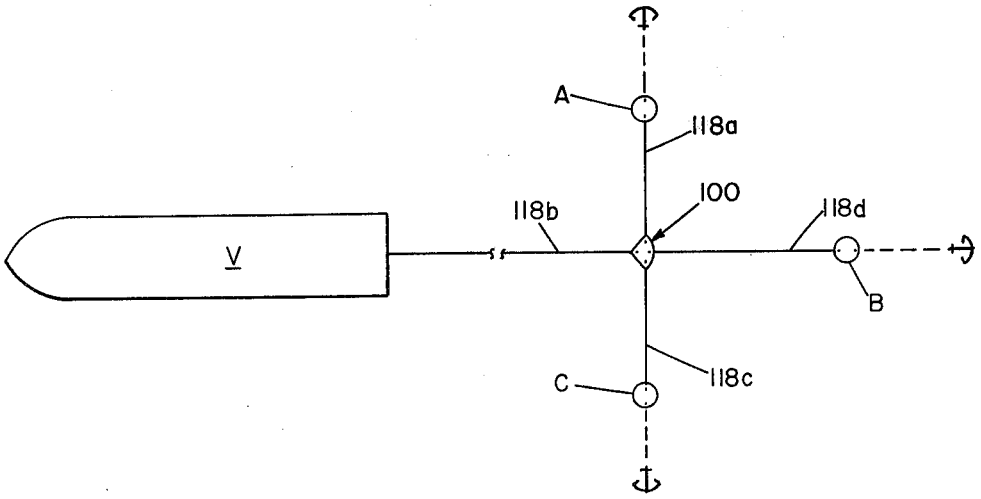
FIG. 5 is a schematic illustration of one form of mooring system employing the embodiment of FIGS. 3 and 4.

Use of the multi-shroud unit is illustrated in FIG. 5. There it will be seen that the unit 100 is suspended by ropes 118$^a$, 118$^c$ between buoys A and C. Rope or steel cable 150 connects the unit to buoy B. The buoys are appropriately anchored by means not shown. Rope 118$^b$, secures the stern of vessel V in desired location for loading and unloading. The arrangement permits ready engagement and disengagement of the mooring ropes and there is manifest weight saving over other possible systems.

I claim:

1. A fitting in a rope providing for connection of said rope to marine gear, said fitting comprising a recurving portion with a crown formed in said rope, a load-distributing structure positioned within said recurving portion, said distributing structure having an aperture therethrough passing within said recurving portion in a direction perpendicular to the plane thereof for insertion of a shackle bolt, said load-distributing structure providing a bearing surface for a shackle bolt and distributing a force applied by a shackle bolt to said bearing surface to the crown of said recurving portion, and a mass of tough, wear-resistant material encapsulating said crown and said load-distributing structure to form an integral plug, said plug being shaped to be inserted into and mate with a protective shroud of predetermined interior shape, said plug being non-adhering to said shroud to permit easy removal therefrom.

2. A fitting as claimed in claim 1 wherein said wear-resistant material comprises a castable urethane rubber with ether type linkages and having a Shore hardness in a range between 70A and 50D.

3. A fitting as claimed in claim 1 or 2 wherein said aperture is cylindrical and sized to provide a close fit with the bolt of the shackle with which said fitting is to be used, whereby wear due to relative motion between said plug and a shackle will be confined to the cylindrical inner bearing surface of said aperture and the closely fitting outer surface of said shackle bolt.

4. A fitting as claimed in claim 1, 2 or 3 wherein said load-distributing structure includes a sheave.

5. A device for receiving, holding and protecting a rope fitting which comprises a recurving portion with a crown formed in the rope, a load distributing body positioned within the recurving portion and a mass of tough wear resistant material encapsulating the recurving portion of the rope and the load distributing body to form a plug of predetermined dimensions and configuration with generally flat opposite sides parallel to the plane of said recurving portion, said plug having an aperture therethrough passing within said recurving portion and said load distributing body, said device comprising a pair of spaced generally parallel metal walls whose facing surfaces are smooth, spaced from each other by a distance equal to the smallest dimension of said plug and adapted to engage and support the flat sides of the latter when inserted therebetween, said walls being provided with opposed openings located in alignment with said aperture of said plug when the latter is in its inserted position so that a shackle bolt will pass through the aligned openings to retain said plug in position, and the edges of said walls being flared to provide non-chafing bearing surfaces for the adjacent portions of said rope.

6. The combination as claimed in claim 5 wherein said device comprises a bell-shaped metallic envelope whose internal size and shape match those of said plug.

7. The combination as claimed in claim 5 wherein said device comprises a pair of metallic plates whose inner-surfaces define said walls and means for holding the same in spaced relationship to each other, said device providing one or more locations adapted to receive and hold a corresponding number of said plugs.

8. In combination:

a fitting in a rope providing for connection of said rope by means of a shackle to marine gear, said fitting comprising a recurving portion with a crown formed in said rope, a load-distributing structure positioned within said recurving portion, said distributing structure having an aperture therethrough passing within said recurving portion in a direction perpendicular to the plane of said recurving portion for insertion of a shackle bolt, said structure providing a bearing surface for a shackle bolt distributing a force applied by a shackle bolt thereupon to said crown, and a mass of tough, wear-resistant material encapsulating said recurving portion of rope and said load-distributing structure to form an integral plug, said plug being shaped to be inserted into and mate with a protective shroud, and a protective shroud generally shaped to engage, cover and protect said plug, said shroud having an interior surface mating with and permitting insertion and withdrawal of said plug, said shroud having two opposed side openings positioned to be in alignment with said aperture when said plug is inserted in said shroud and permitting a shackle bolt to pass through said side openings and said aperture.

9. The combination as claimed in claim 8 wherein said protective shroud comprises a pair of metallic plates whose inner surfaces define the plug engaging shroud surfaces and means for holding the same in spaced relationship to each other said shroud providing one or more locations adapted to receive and hold a corresponding number of said plugs.

* * * * *

UNITED STATES PATENT AND TRADEMARK OFFICE

CERTIFICATE OF CORRECTION

PATENT NO. : 4,164,378

DATED : August 14, 1979

INVENTOR(S) : Joseph J. Linehan

It is certified that error appears in the above-identified patent and that said Letters Patent are hereby corrected as shown below:

In Claim 5, Column 6, Line 1, "flared" should be --faired--.

Signed and Sealed this

*Fourth* Day of *December 1979*

[SEAL]

*Attest:*

SIDNEY A. DIAMOND

*Attesting Officer*

*Commissioner of Patents and Trademarks*